United States Patent [19]

Warner

[11] 3,948,379

[45] Apr. 6, 1976

[54] VIBRATING CHAIR

[76] Inventor: Harry J. Warner, 1229 Hunt Road, Salt Lake City, Utah 84117

[22] Filed: Aug. 28, 1974

[21] Appl. No.: 501,377

[52] U.S. Cl. ..... 194/9 T; 132/9; 194/16; 297/180; 297/217; 128/33; 128/24.1; 34/99

[51] Int. Cl.[2] ..... G07F 5/10

[58] Field of Search... 194/1 R, 9, 9 T, 11, DIG. 18, 194/16; 297/180, 217; 128/33, 38–40, 24.1; 34/96, 99–101; 132/9, 40

[56] References Cited

UNITED STATES PATENTS

| | | | |
|---|---|---|---|
| 2,189,430 | 2/1940 | McClure | 34/99 |
| 2,602,492 | 7/1952 | Fowler et al. | 297/217 |
| 2,612,975 | 10/1952 | Gallagher et al. | 194/9 T |
| 2,769,247 | 11/1956 | Krueger | 34/100 |
| 2,776,496 | 1/1957 | Hudson | 297/217 |
| 2,937,641 | 5/1960 | Oetinger | 128/33 |
| 3,092,100 | 6/1963 | Oetinger | 128/33 |
| 3,209,766 | 10/1965 | Dannat | 132/40 |
| 3,438,455 | 4/1966 | Redmond | 180/82.6 |
| 3,691,646 | 9/1972 | Ruffolo | 34/99 |

FOREIGN PATENTS OR APPLICATIONS

| | | | |
|---|---|---|---|
| 651,885 | 4/1951 | United Kingdom | 34/99 |
| 882,474 | 11/1961 | United Kingdom | 34/99 |

*Primary Examiner*—Robert B. Reeves
*Assistant Examiner*—H. Grant Skaggs
*Attorney, Agent, or Firm*—Lynn G. Foster

[57] ABSTRACT

A vibrating, reclining chair having a hair dryer mechanism mounted to the chair with the hood of the dryer adapted to support the head of the user when the chair is reclined in whole or in part. Any one of several head supports may be used within the hood of the dryer. The chair is coin operated and may be equipped with an audio alarm which is actuated when the user fails to timely insert a coin into the coin box. In one configuration, the dryer mechanism is optional and a plurality of said chairs are mounted to a common base.

1 Claim, 13 Drawing Figures

VIBRATING CHAIR

BACKGROUND

1. Field of Invention

The present invention relates generally to vibrating chairs and more particularly to reclining vibrating chairs which are coin operated and which may trigger an audio alarm when a coin is not properly inserted. In the preferred embodiment, a hair dryer mechanism is mounted to the reclining vibrating chair.

2. Prior Art

The prior art of which the Applicant is aware consists of rigid, erect chairs integrally or separately equipped with a drying mechanism adapted to service the needs of the user only in an upright or erect position. Consequently, the comfort of the user is in large measure disregarded and the experience is often somewhat unpleasant.

BRIEF SUMMARY AND OBJECTS OF THE PRESENT INVENTION

The present invention comprises a reclining vibrating chair which is coin operated, may have an alarm to indicate when the user has not properly inserted a coin and is preferably equipped with a dryer mechanism which is self contained including a blower, a heating element and a hood in which the user places her hair as she is seated in the reclining vibrating chair, the hood comprising interior supports for holding the user's head in an appropriate drying position independent of the angle to which the chair is reclined, allowing the user to sleep or otherwise relax during the drying phenomenon.

With the foregoing in mind, it is a primary object of the present invention to provide a novel reclining chair.

It is a further object to provide an improved reclining and vibrating chair equipped with a hair dryer mechanism.

It is a further paramount object of the present invention to provide a reclining chair which vibrates and is equipped with a hair dryer mechanism which supports the head of the user in all reclined postures.

It is a further object of the present invention to provide a novel array of reclining, vibrating chairs which are coin operated and equipped with an audible alarm to insure proper payment for use.

These and other objects and features of the present invention will be apparent from the following detailed description, taken with reference to the accompanying drawings.

DETAILED DESCRIPTION OF THE ILLUSTRATED EMBODIMENTS

Figure 1:
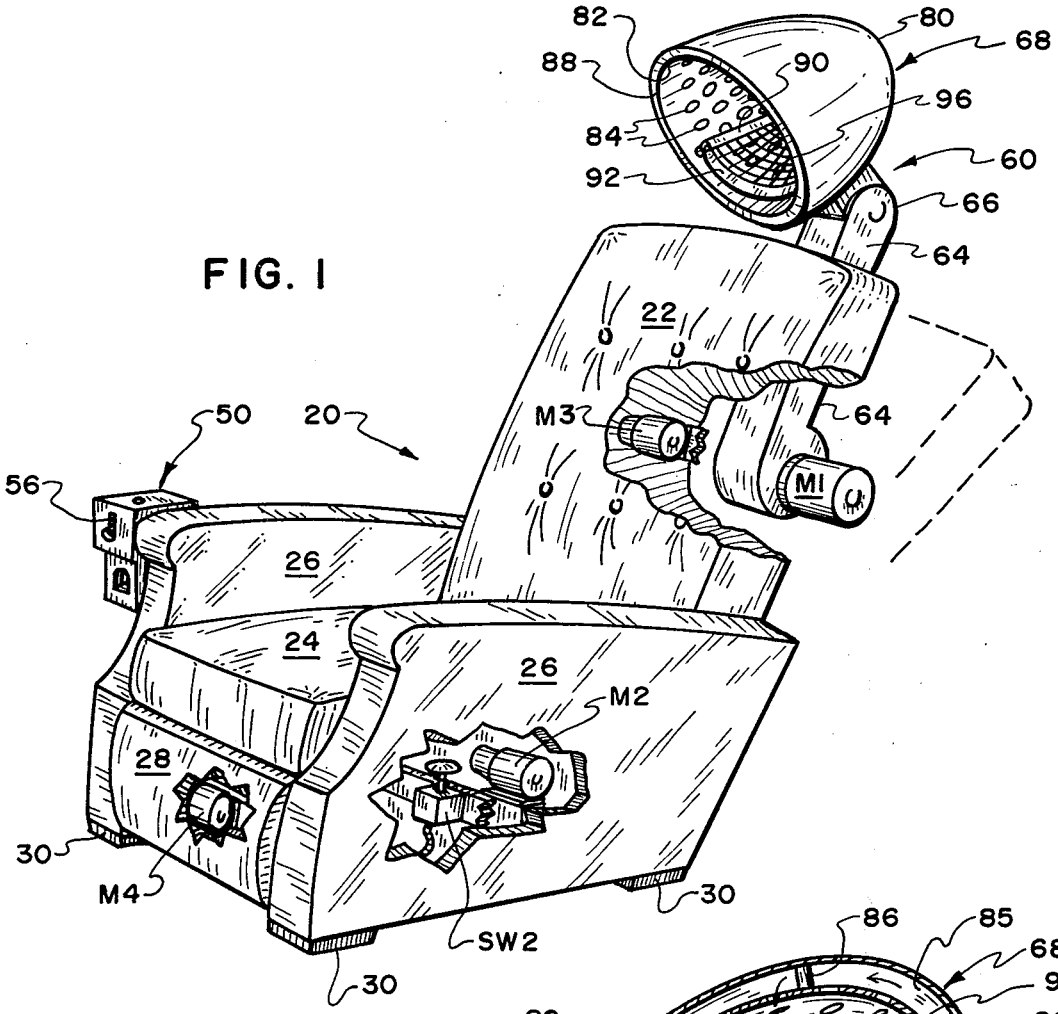
FIG. 1 is a perspective representation of a presently preferred chair embodiment in accordance with the present invention with parts broken away to add clarity.

Reference is now made to the drawings wherein like numerals are used to designate like parts throughout. FIG. 1 illustrates a vibrating, reclining chair, generally designated 20. While any vibrating and reclining chair may be used the illustrated chair comprises an upholstered back 22, an upholstered seat 24, opposed upholstered arms 26 and a foot rest 28. The specific frame work and the structure by which the chair is reclined and subsequently displaced to an erect position are matters well known in the art and need not be explained in this specification. Suffice it to say that the chair has conventional parts for tilting the same into any one of several reclined positions and is equipped at one or more locations with an adjustable vibrating motor secured to the frame (three of which are shown at M2, M3 and M4). The chair is illustrated as having a plurality of floor-engaging foot pedestals 30.

Figure 2:
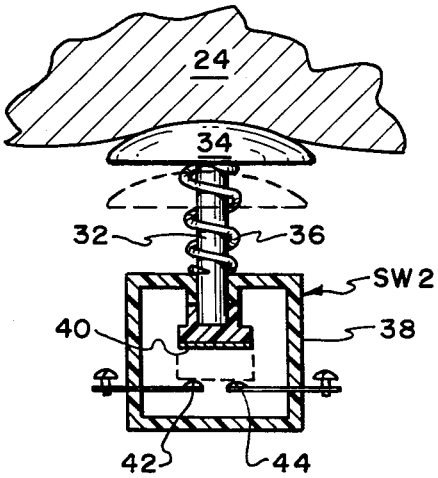
FIG. 2 is a front elevation view partly in section illustrating a currently preferred switch for actuating the audible alarm when proper payment for use of the chair of FIG. 1 has not been made.

A switch SW2, which is optional, is mounted to the frame of the chair immediately beneath the seat 24 so that when the seat is unoccupied the switch SW2 is fully extended to its off condition, and when the seat 24 is occupied the switch SW2 is closed. More specifically, in reference to FIG. 2, the switch SW2 comprises a stem 32 which terminates in a head 34, shown to be contiguous with the lower surface of the seat 24. The stem 32 is biased upward by a coiled spring 36 which abuts the lower surface of the head 34 and the top surface of an enclosure 38. A conductive plate 40 is secured to the bottom of the stem 32 and, in the depressed condition when a user occupies a seat 24 will engage a pair of spaced conductors 42 and a pair of spaced conductors 44 thereby closing the switch as shown in the dotted lines in FIG. 2. This initiates an audible alarm, also optional, unless the alarm circuit is inactivated as hereinafter more fully explained.

The chair 20 is also equipped with a conventional coin box 50, illustrated as mounted adjacent one of the arms 26. The coin box 50 is conventional, being equipped with a slot 52 in which a coin is inserted and comprising a coin-initiated time mechanism 51 (FIG. 13), which disables the alarm for a predetermined interval of time.

Figure 3:
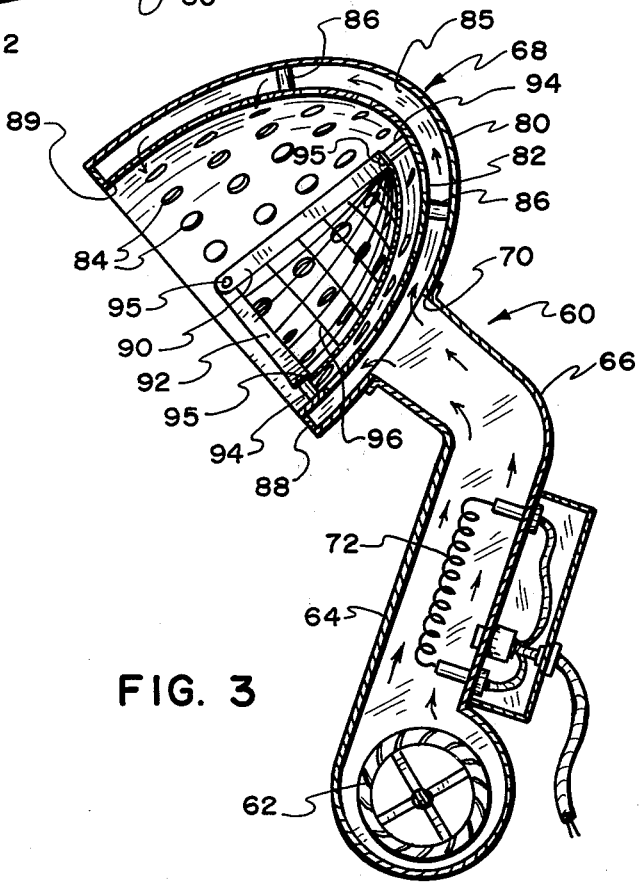
FIG. 3 is a vertical cross section of the dryer mechanism of FIG. 1.

The chair 20, as best illustrated in FIGS. 1 and 3 is equipped with a dryer mechanism 60. The dryer mechanism 60 comprises a motor M1, which, upon rotation, turns a squirrel cage assembly 62 thereby driving air along a closed conduit 64, which comprises an elbow 66, to the interior of a hood 68 through an opening 70 therein. The conduit 64 is equipped with one or more thermostatically controlled heating elements 72, whereby the magnitude of heat thereby created during any interval of time is regulated. Thus, air displaced by the squirrel cage assembly 62 is heated as it crosses the heating element 72, the hot air ultimately being discharged into the hood 68 through the opening 70. While the dryer mechanism 60 is illustrated as previously explained, it is to be appreciated that other configurations could be used, e.g. the motor, blower and heating element could be situated within or directly adjacent the hood 68, if desired.

The hood 68, as illustrated, comprises an outer rigid concave shell 80 and an inner rigid concave shell 82 of reduced size, each preferably of suitable heat resistant plastic, the space between the two shells defining a plenum for the distribution of hot air through an array of openings 84 directly against the hair of the user. Suitable structural supports 86 maintain the spacing 85 between the two shells and an annular seal 88 forces discharge of hot air through the ports 84 and ultimately out the hood opening 89.

The interior shell 82 comprises a pair of semi-circular plastic or other suitable straps 90 and 92, which are disposed at essentially 90° one to the other such that strap 90 runs somewhat centrally over the top of the head of the user when the user's head is in the hood 68 and the other strap 92 supports the back of the head. The straps 90 and 92 are supported upon fastener studs 94 by rivets 95 so that the illustrated arrangement is maintained. A netting 96, suitably bonded to the straps 90 and 92, spans and fully fills the area between the supports 90 and 92 thereby serving to cradle the head of the user away from the shell 82 so that adequate circulation of hot air will occur independent of the reclined position of the chair 20. Thus, the user may sleep or otherwise relax in a reclined position with one or more vibrators of the chair on or off, as desired.

Figure 4:
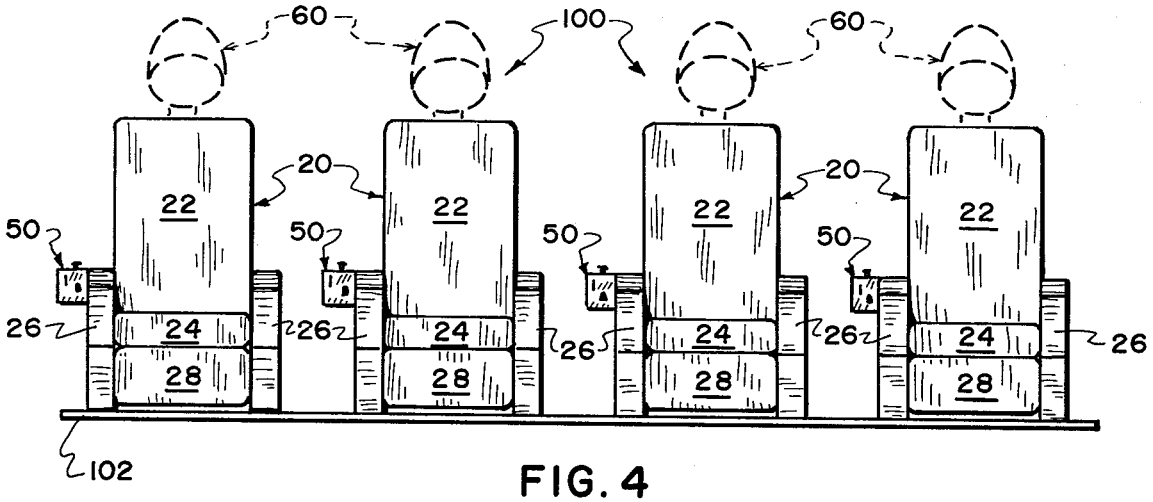
FIG. 4 is a further embodiment comprising an array of vibrating reclining chairs in accordance with the present invention.

With reference to FIG. 4, an array 100 of chairs 20 is illustrated, the chairs being equipped with the audio alarm and optionally equipped with the dryer mechanism 60 and secured one to another by a common base frame 102, which may be of any suitable material and configuration. The array 100 is often desirable for installation in public areas, such as airports, where people are required to wait for relatively long periods of time.

Specific reference is now made to FIGS. 5–12, which illustrate a variety of ways in which the head of the user may be supported within the hood of the dryer mechanism. For purposes of clarity and simplicity, the details of the hood have not been repeated and the precise structural configuration of the hood is immaterial for purposes of this portion of the description. Each of the hoods fragmentarily illustrated in FIGS. 5–12 comprise a shell 110 into which hot air is appropriately displaced, for example through an intake opening 112. Each of the structures shown interior of the shell 110 in FIGS. 5–12 are intended to fully support the head of the user when fully or partially reclined in the chair 20 in such a fashion as to adequately accommodate drying.

Figure 5:
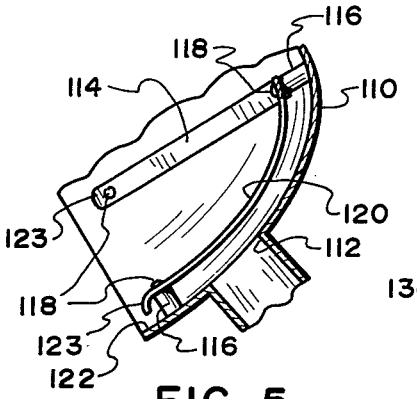
FIGS. 5–12 are cross section representations of the hood of the dryer of FIG. 1 illustrating various types of head rests or head supports which may be used.

In reference to FIG. 5, a somewhat semi-circular plastic strap 114 extends essentially parallel to the axis of the shell 110 and is mounted upon stud supports 116 by rivets 118. At least one additional strap 120 is likewise supported and spans from one of said intermediate supports 116 (which also carries the strap 114) to a position adjacent the opening 122 of the hood near the lowest part therof. Each strap end adjacent the opening 122 terminates in a curved portion 123. Thus, the straps 114 and 120 cradle the head of the user to provide full support and at the same time accommodate facile flow of hot air to the hair of the user.

Figure 6:
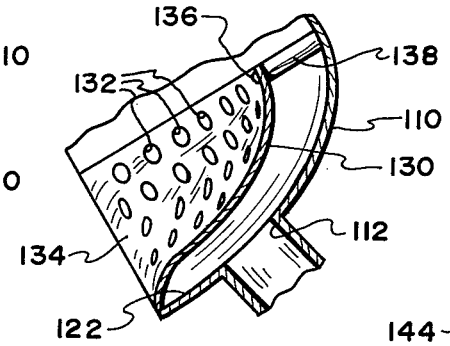

FIG. 6 illustrates a substantially rigid plastic head rest 130 having a matrix of openings 132 and a somewhat S-shaped though arcuate configuration to match the neck and back of the head of the user. The head rest 130 is integral with the shell 110 at lip 134 adjacent the opening 122 and is centrally held in the illustrated position by one or more supports 138 bridging between the central portion 136 of the head rest 130 and the adjacent portion of the shell 110, the support 138 being integral with each.

Figure 7:
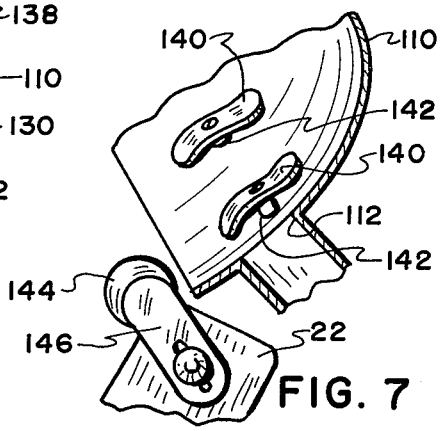

In regard to FIG. 7, a pair of S-shaped head rests 140 are positioned in spaced relation one to the other so as to engage, eccentrically, the back of the head of the user, each head rest 140 being supported upon a screw-secured stud 142. A cushion 144 is mounted upon a bracket 146, which in turn is mounted to the interior frame of the back 22 of the chair 20. The neck rest 144 is preferably upholstered, and designed and placed to engage the neck of the user.

Figure 8:
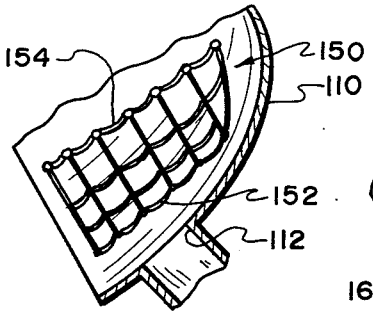

The hood embodiment of FIG. 8 comprises a net 150 in the shape of one half of a hemisphere. The central portion 152 of the net being suspended and so held by engaging along the opposed edges 154 of the net 150 with the shell 110, the edges 154 being there secured by a suitable bonding agent such as activated epoxy resin.

Figure 9:
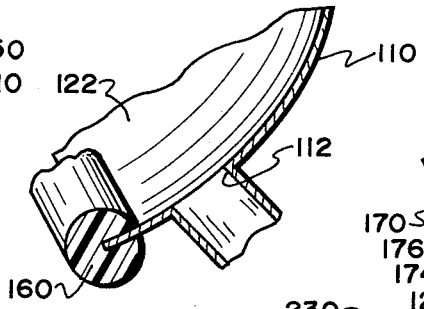

The dryer hood embodiment of FIG. 9 comprises an enlarged upholstered neck/head rest 160 preferably of covered foam material of such a size and located so as to engage the upper portion of the neck of the user as well as the lower portion of the back of the head of the user. The configuration of the neck/head rest 160 is circular in cross section and semi-arcuate from end to end.

Figure 10:
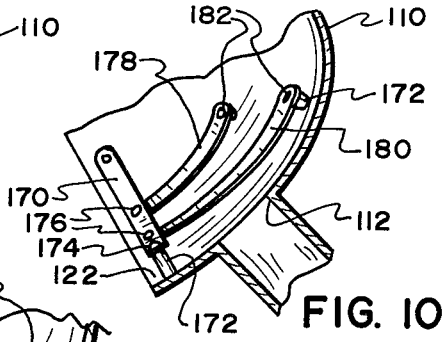

The hood embodiment of FIG. 10 comprises a plurality of straps, strap 170 being semi-circular in nature and essentially spanning the lower half of the opening 122 transverse to the axis of the hood and in spaced relation to the hood being supported upon studs 172 using rivets 174. Rivets 176 secure diagonal straps 178 and an axial strap 180 in the illustrated positions, the upper ends of each of the last mentioned straps being secured by rivets 182 upon studs 172.

Figure 11:
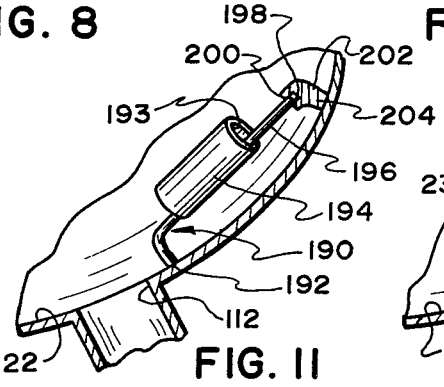

The embodiment of FIG. 11 illustrates a further manner in which the head of the user may be supported within the shell 110 of the dryer hood. More specifically, an L-shaped plastic rod 190 is integral at its lower end 192 with the shell 110. The L-shaped rod 190 passes loosely through the hollow interior 193 of the curler 194, the distal free end 196 of which projects beyond the curler 194. The head 198 at the terminal end of the proximal portion 196 of the L-shaped rod 190 is of a tear drop or like configuration and is adapted to be press fit into a matching female recess 200 of a fastener 202 the end 204 of which is integral with the shell 100. Thus, once curlers have been appropriately placed in the hair of the user, a plurality of rods 190 are respectively fitted through the hollow 193 of each curler 194 and the rods are appropriately secured at their distal ends to a matching fastener recess whereby the curlers in conjunction with the rods suspend the head of the user within the shell 110.

Figure 12:
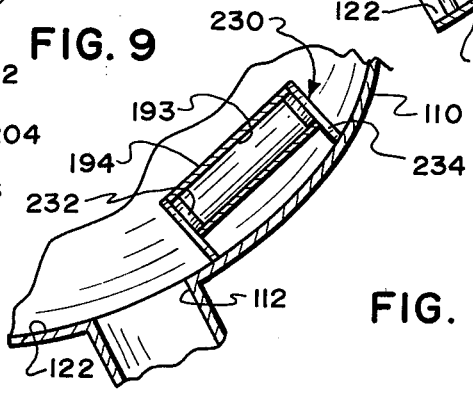

Reference is now made to the hood embodiment of FIG. 12. In this embodiment, a plurality of curlers 194, having a hollow interior 193, are equipped with end plugs 230. Each end plug 230 comprises a male extension 232 which is press fit into the hollow 193 at one or the other end of the curler 194. Each end member 230 also comprises an external leg 234 which in no way is connected to, but is designed to rest upon the interior surface of the shell 110. Thus, with a plurality of curlers 194 each equipped with the end members 230 having the legs 234 thereof oriented away from the head of the user and upon which the hair of the user has been coiled, the user merely places the head into the shell 110 and adequate head support is provided by engagement between the legs 234 and the interior surface of the shell 110 independent of where each leg 234 may come to rest.

Figure 13:
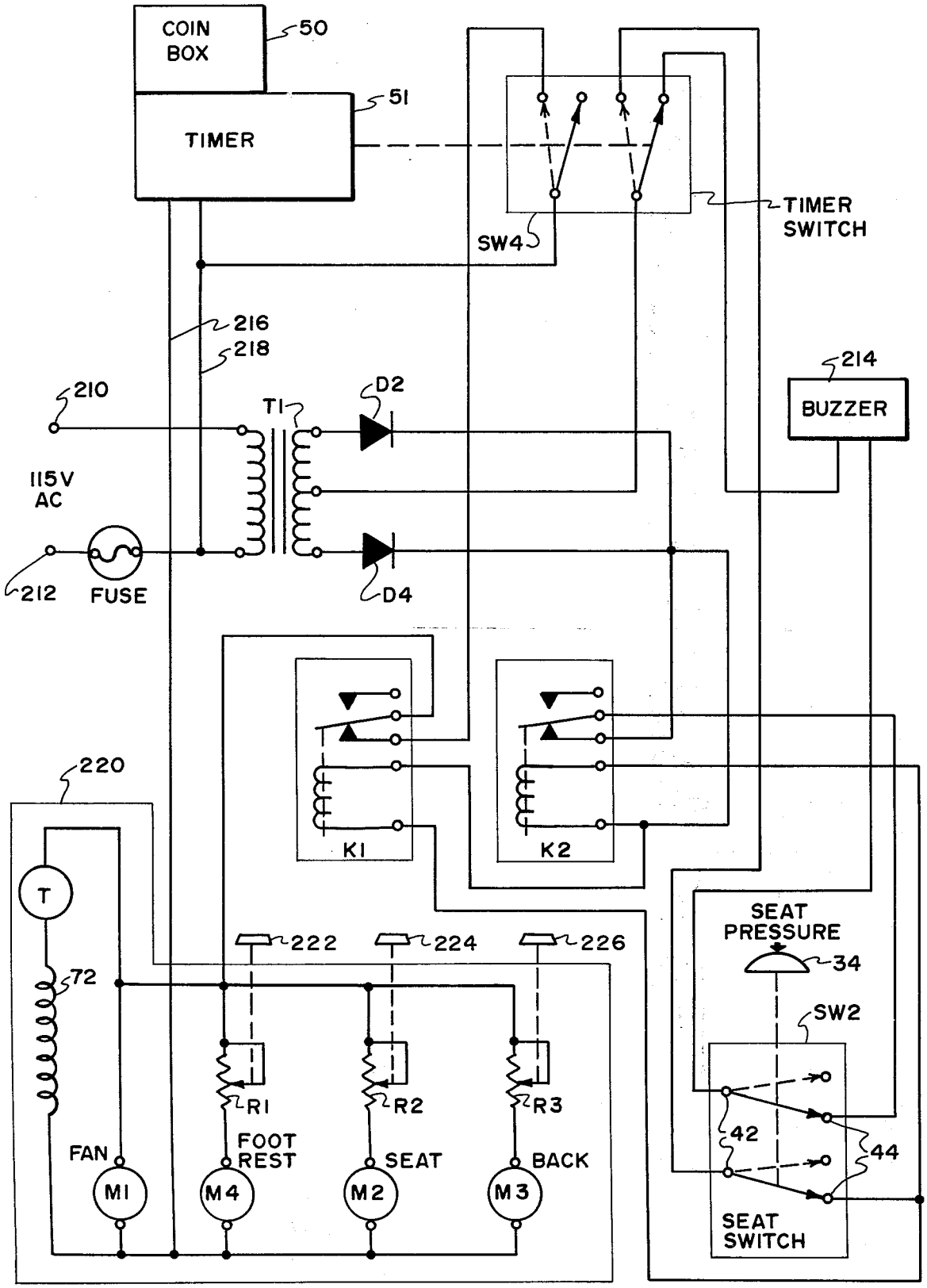
FIG. 13 is a diagram of the circuit of the chair of FIG. 1.

Reference is now made to FIGS. 1 and 13 for the purpose of describing the presently preferred electrical circuitry comprising chair 20. Conventional household power is provided by a suitable electrical cord to terminals 210 and 212 of the circuit of FIG. 12. The conventional coin box 50 comprises timer 51 which, when actuated, controls the timer switch SW4 so as to disable seat switch SW2, if SW2 is supplied. The timer 51 also controls the hair dryer motor M1 and the vibrator motors M2, M3 and M4. The circuit also comprises an audio alarm 214 when SW2 is used. More specifically, a 115 volt AC conventional household source of power at terminals 210 and 212 is communicated directly by conductors 216 and 218 to the timer 51 and thence to a motor circuit 220. The incoming AC power is also transformed at transformer T1 into low voltage power, 12 volts being suitable. The low voltage power is communicated across diodes D2 and D4 and utilized in conjunction with relays K1 and K2 as well as the audio alarm system which comprises switch SW2 and buzzer 214.

Thus, the timer 51 (when switch SW4 is in the position illustrated in solid lines and switch SW2 also in the position illustrated in solid lines) actuates the buzzer 214 to sound an alarm indicating the user has not placed a coin in the coin box 50. Also, motors M1–M4 will not operate without proper placement of a coin. However, with a coin placed appropriately in the coin box 50 and the predetermined length of time running in respect to timer 51, the timer 51 shifts switch SW4 into the position illustrated in dotted lines bypassing the buzzer so that no audible warning is sounded and enables the motor circuit 220. Obviously, when the seat button 34 is extended, the switch SW2 is in a dotted position.

As mentioned, 110 volt AC household power is communicated through the timer 51 to the dryer motor M1 as well as vibrator motors M2, M3 and M4, the thermostat T being selectively settable so as to control the amount of current allowed to flow to heating element 72. Control knobs 224 and 226 may be set to regulate the speed of motors M2 and M3, respectively, by controlling the amount of current flow permitted across potentiometers R2 and R3. Motor M2 is mounted adjacent the seat 24 of the chair and vibrates the same, motor M3 is mounted to vibrate the back 22 and motor M4 is mounted to the foot rest. If desired, an additional motor could comprise circuit 220 and be used in conjunction with a hydraulic base for the chair whereby the elevation of the seat 24 of the chair above the floor could be varied at the option of the operator, all of which is conventional.

The invention may be embodied in other specific forms without departing from the spirit or essential characteristics therof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A chair assembly comprising:

a reclining chair having a seat and an adjustable back;

electrical means for vibrating at least part of the chair;

an audio alarm carried by the chair;

switch means connected to the audio alarm and located below the chair seat to be activated when the seat is occupied by a user;

coin-operated timer means comprising means (a) disabling the audio alarm and enabling the vibrating means for a predetermined interval of time when a coin is properly inserted and (b) enabling the audio alarm and disabling the vibrating means when the coin is not properly inserted;

a hair dryer mechanism adjustably carried by the back of the chair comprising blower means and hood means, the hair dryer mechanism also comprising head support means disposed within and cooperating with the hood means to hold the head of the user in a disposition accommodating air circulation about the head within the hood means independent of the angle at which the chair is reclined and the adjusted position of the hood means, said hair dryer mechanism further comprising means electrically connected to the timer means enabling the hair dryer mechanism for said predetermined interval of time when a coin is properly inserted and otherwise disabling the hair dryer mechanism.

* * * * *